US006062556A

United States Patent [19]

McCay

[11] Patent Number: 6,062,556

[45] Date of Patent: May 16, 2000

[54] METHOD AND APPARATUS FOR MERGING SHEETS

[75] Inventor: Steve W. McCay, Raleigh, N.C.

[73] Assignee: Bell & Howell Mail and Messaging Technologies Company, Durham, N.C.

[21] Appl. No.: 09/137,633

[22] Filed: Aug. 21, 1998

[51] Int. Cl.[7] ..... B65H 3/44

[52] U.S. Cl. ..... 271/9.13; 271/225; 271/256; 271/270

[58] Field of Search ..... 271/9.13, 9.12, 271/252, 256, 264, 270, 272, 202, 314; 198/448

[56] References Cited

U.S. PATENT DOCUMENTS 3,693,486 9/1972 Maniaci et al. ..... 198/448 X
4,696,464 9/1987 Gämmerler ..... 271/9.13 X
5,104,104 4/1992 Mol ..... 270/52.5
5,362,039 11/1994 Kusters ..... 271/225
5,439,208 8/1995 Moser et al. ..... 271/225
5,768,959 6/1998 Lorenzo ..... 83/74

*Primary Examiner*—David H. Bollinger
*Attorney, Agent, or Firm*—Jenkins & Wilson, P.A.

[57] ABSTRACT

Apparatus and method for merging sheet streams conveyed in side-by-side streams in a conveying direction into a single stream. An infeed conveyor conveys at least two sheet streams side-by side in a direction toward a merger. The merger separates and separately conveys the sheet streams to a merge location. The sheet streams are transported at different accelerations or speeds, such that each article of one of the sheet streams is directed into a gap between the articles of the other sheet stream in order to produce a single, merged sheet stream traveling at an accelerated outfeed speed for further processing.

36 Claims, 5 Drawing Sheets

METHOD AND APPARATUS FOR MERGING SHEETS

TECHNICAL FIELD

The present invention relates generally to the art of sheet processing. More particularly, the present invention relates to an apparatus and method for merging two sheet streams into a single sheet stream.

BACKGROUND OF THE INVENTION

The use of what is known as "two-up" sheet material has become very common in the sheet material arts. Prior art, two-up sheet material, as shown in FIG. 1, comprises a long continuous web of sheet material onto which the subject matter for separate pages 2 are printed side-by-side on the web. While FIG. 1 shows the two-up material wrapped around and formed into a roll, it is equally plausible that the two-up material can be fan-folded.

Typically, this long web with the side-by-side printing will be provided to an end-user for further processing. Such further processing will typically include separating each of the pages from the rest of the web so that various operations such as collecting, accumulating, and folding can be carried out prior to sending the sheets to a downstream inserter machine. This separating part of the further processing is shown in FIGS. 2A, 2B.

As shown in FIG. 2A, the continuous web material 1 is fed downstream in the feed direction symbolized by arrow F. Continuous web material 1 is then slit down its center axis, thereby forming side-by-side webs 1*a*, 1*b* separated by slit S. The slitting step can be carried out by an overhead slitter blade 15 supported by a shaft 10 or any other type of slitter since the mechanism used for the slitting is not critical to the instant invention.

After the slitting step, as shown in FIG. 2B, a blade 30 of some type is used to cross-cut the two side-by-side webs 1*a*, 1*b*, across their transverse axes. This cross-cut totally separates sheets 20*a* and 20*b* from the two side-by-side webs 1*a*, 1*b*. The action of blade 30 is repeated and therefore two side-by-side streams of sheet material are then formed and fed to a downstream operation such as an accumulator, collector, or folder.

It is typically desired that these two side-by-side streams be merged into a single stream because most downstream operations cannot handle doublewide sheet material. Accordingly, methods of merging side-by-side streams have been implemented. For example, in U.S. Pat. No. 5,362,039 to Kusters, assigned to Bell & Howell GmbH, multiple such methods are shown in FIG. 3. A problem with the Kusters method, however, is that the orientation of the sheets is changed during the merging. That is, not only is the sheet path turned 90°, but the sheets are also flipped over. As can be appreciated by those of skill in the art, there are applications, however, in which this change of orientation is undesirable.

Accordingly, there is room for improvement within the art.

DISCLOSURE OF THE INVENTION

It is therefore an object of the present invention to provide a method and apparatus for merging two sheet streams into a single sheet stream.

It a further object of the present invention to provide a method and apparatus for merging two sheet streams into a single sheet stream that does not change the direction of the feed path or flip the sheet stream over.

It is yet a further object of the present invention to provide a method and apparatus for merging two sheet streams into a single sheet stream that is easily adjustable.

These and other objects of the present invention are achieved by an apparatus for merging sheet streams conveyed in side-by-side streams in a conveying direction into a single stream, comprising an infeed conveyor for conveying at least two sheet streams side-by-side in a conveying direction, and a merger for merging the side-by-side sheet streams such that the sheet streams are conveyed in a single stream. The merger comprises means for separating the side-by-side conveyed sheet streams and means for separately conveying the separated sheet streams to a merge location for merger of the sheet streams into a single stream.

These and other objects of the invention are achieved by a method of merging sheets conveyed in two side-by-side streams into a single stream of sheets, comprising the steps of: conveying at least two streams of sheets in a side-by-side relationship in a conveying direction; merging the side-by-side streams of sheets such that the sheets are conveyed in a single stream, whereby merging the sheet streams is accomplished by separating the side-by-side sheet streams; and separately conveying the separated sheet streams to a merge location where the sheet streams are merged into a single stream.

Some of the objects of the invention having been stated hereinabove, other objects will become evident as the description proceeds, when taken in connection with the accompanying drawings as best described hereinbelow.

BEST MODE FOR CARRYING OUT THE INVENTION

With reference to the drawings generally described above, an apparatus and method for merging sheets will now be described that meets and achieves the various objects of the invention set forth above.

Typically, it is desirable to merge two separate streams of sheet material into a single stream. This is because most sheet feeding equipment, such as but not limited to collectors, accumulators, folders, etc., are designed only to handle one-up streams. Accordingly, some type of apparatus and method for converting a two-up stream into a one-up stream is required. Prior art solutions to this requirement and their deficiencies are described above.

Figure 1:
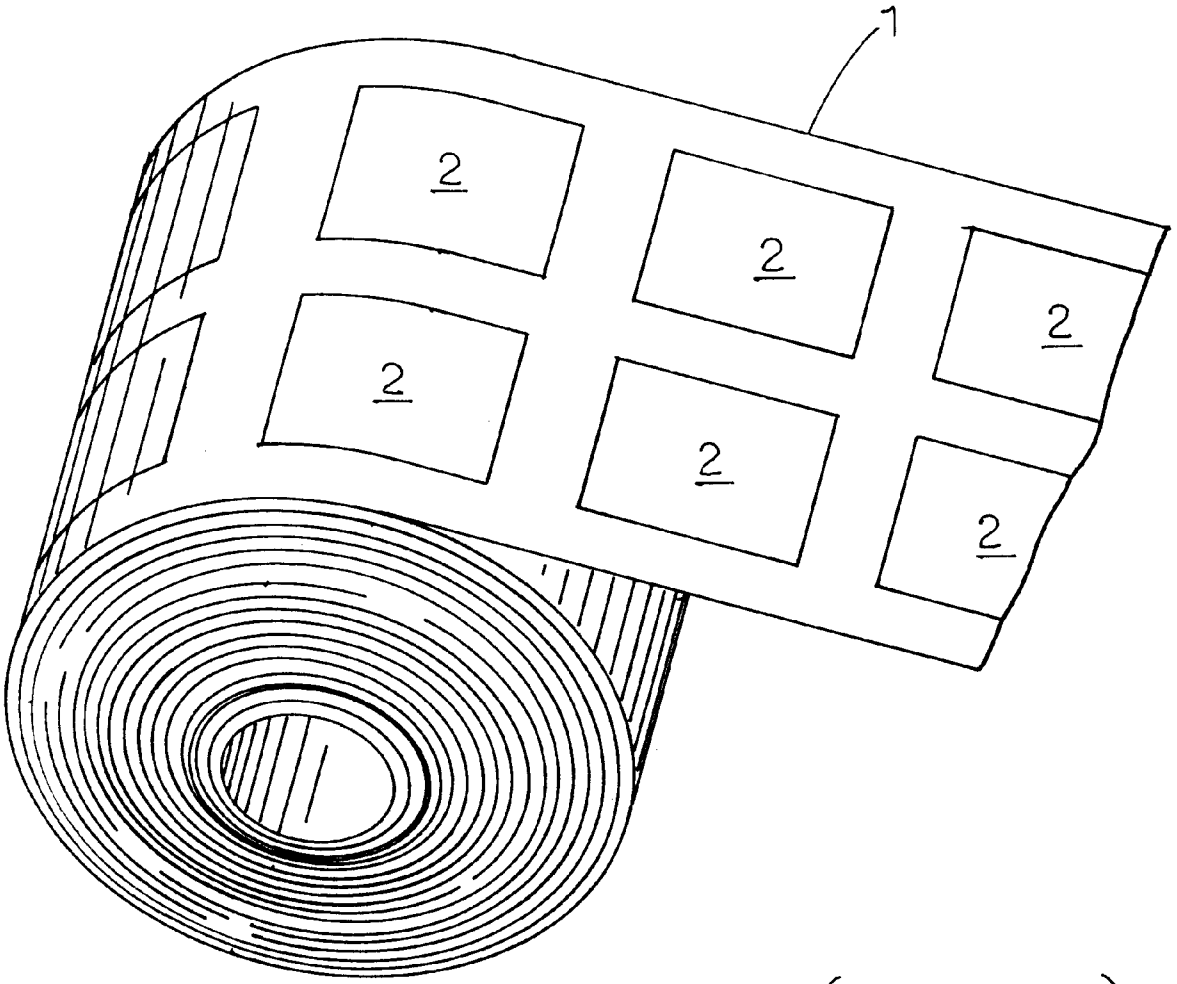
(PRIOR ART) FIG 1
FIG. 1 of the drawings is a perspective view showing a conventional two-up material stream for use with the apparatus and method for merging sheets according to this invention.
Figure 2B:
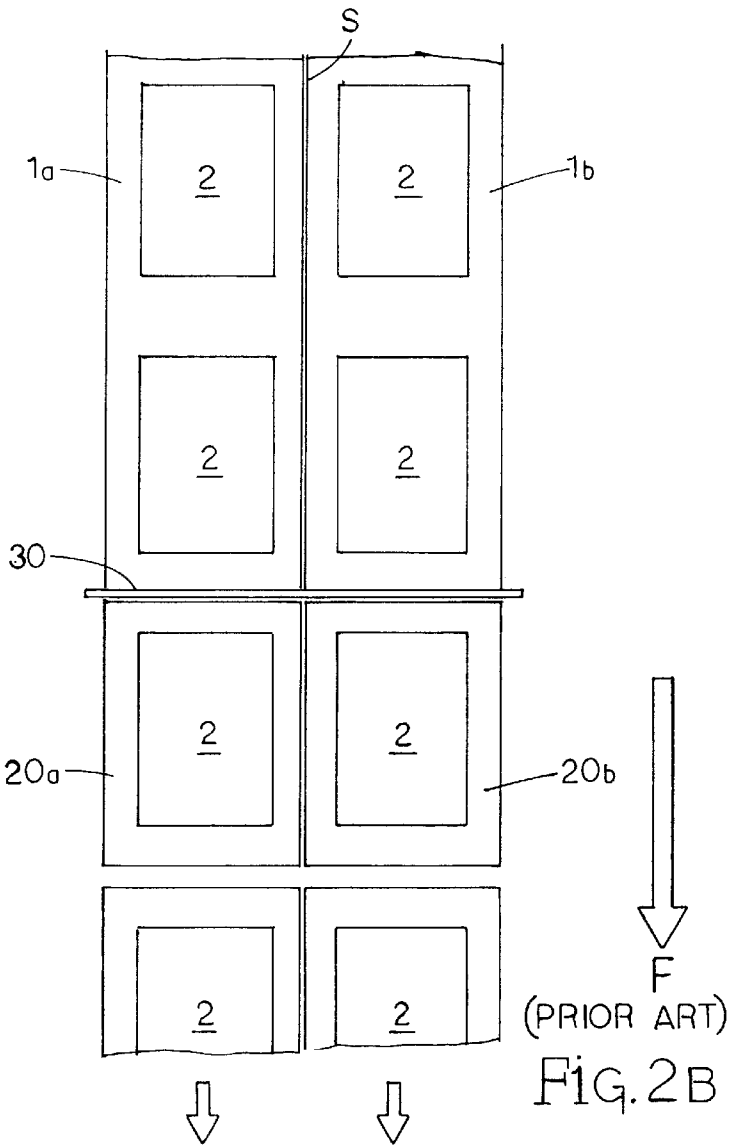
(PRIOR ART) FIG. 2B
FIGS. 2A and 2B of the drawings are plan views showing how a conventional two-up material stream is converted into two side-by-side streams of sheet material.
Figure 2A:
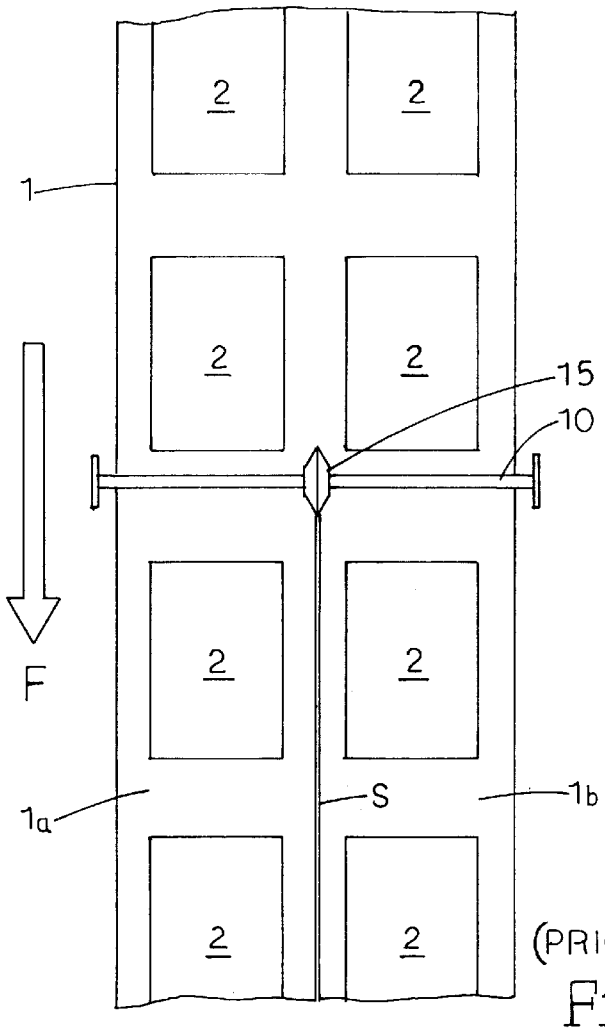
(PRIOR ART) FIG. 2A
Figure 3:
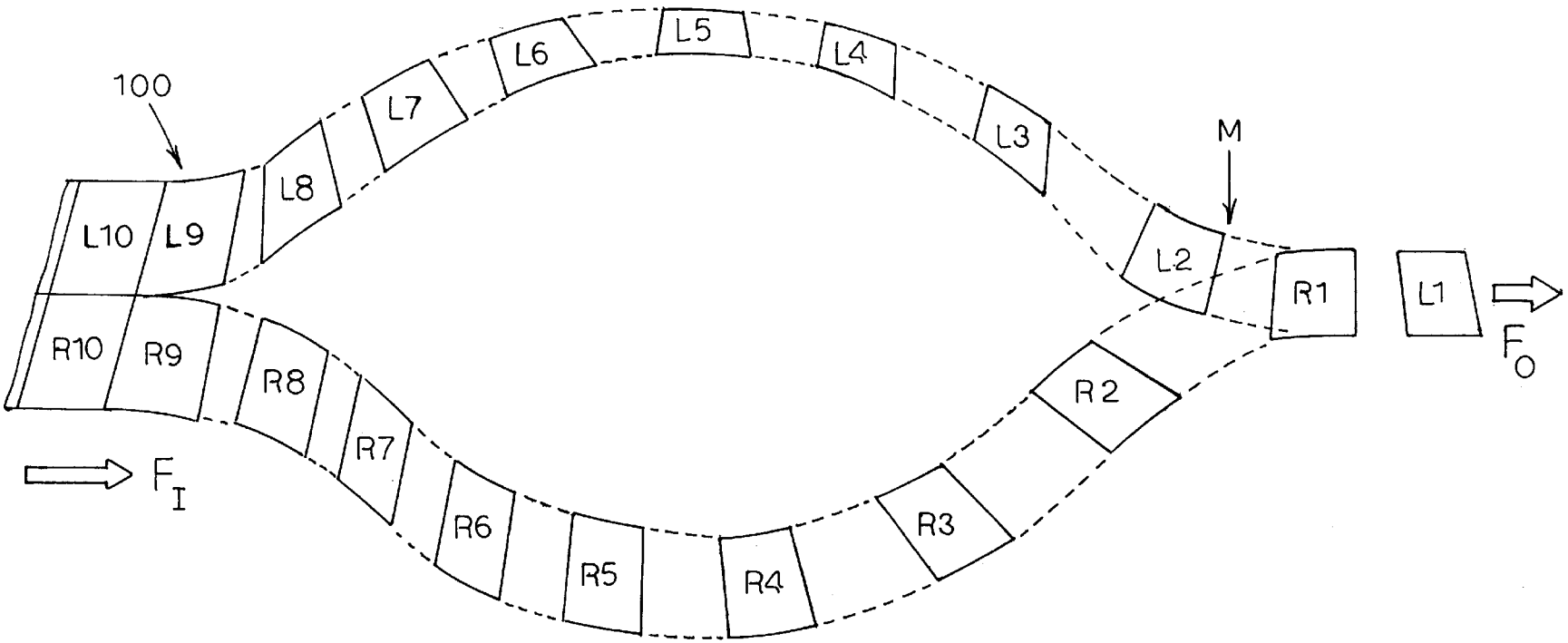
FIG. 3 of the drawings is a perspective view of a method for merging sheets according to this invention.

FIG. 3 is a perspective view of the method for merging sheets according to the invention. In particular, two-up stream 100 is fed in infeed direction $F_1$. As is conventionally preferred, stream 100 is slit down its longitudinal axis and then repetitively cut across its transverse axis so as to form two streams of individual sheets $L_i$, $R_i$. The speed at which the two streams of sheets will be fed in direction $F_1$ is limited by the speed of the cutter or burster used to generate the two sheet streams and will typically be in the range of 90 ips (inches per second).

To merge the two streams of individual sheets, $L_1$, $R_1$, the streams are separated and each stream sent along its own sheet path. In the instant invention it is foreseen that the two streams will be taken off the infeed plane, with one stream taken above the plane and the other stream taken below the plane, as will be further described with respect to FIGS. 4A, 4B, when describing the apparatus below. However, it is further possible to have one stream remain on the infeed sheet plane while the other stream is taken either below or above the infeed sheet plane so long as the sheet planes are vertically spaced so there is room for their respective drive and control mechanisms to be mounted without interfering with each other. It is also possible to keep both sheet streams on the infeed sheet plane but horizontally space the conveyors. However, horizontally spacing the sheet conveyors unnecessarily, unreasonably and undesirably increases the footprint of the overall apparatus.

Streams $L_i$, $R_i$, are fed along their separate paths according to certain acceleration/speed profiles. The acceleration/speed profiles are set so as to cause the following three things to occur: (a) the sheets of each stream are accelerated to the outfeed speed $F_O$, typically in the range of 200 ips; (b) the distance between adjacent sheets in a sheet stream (i.e., the gap between sheets) is increased to an amount larger than the length of a sheet; and (c) the two sheet streams are placed 180° out of phase. While the first two are self-explanatory, what is meant by the two streams being placed 180° out of phase is that at the merge position M, when a sheet of one stream is at merge position M, a gap from the other stream is at that same position. This way, sheets from one stream fill the gaps of the other stream to form the single merged stream.

Finally, after the sheet streams are merged at merge position M, they are fed in the outfeed direction $_{OF}$ and at the outfeed speed to the various possible downstream operations.

Figure 4A:
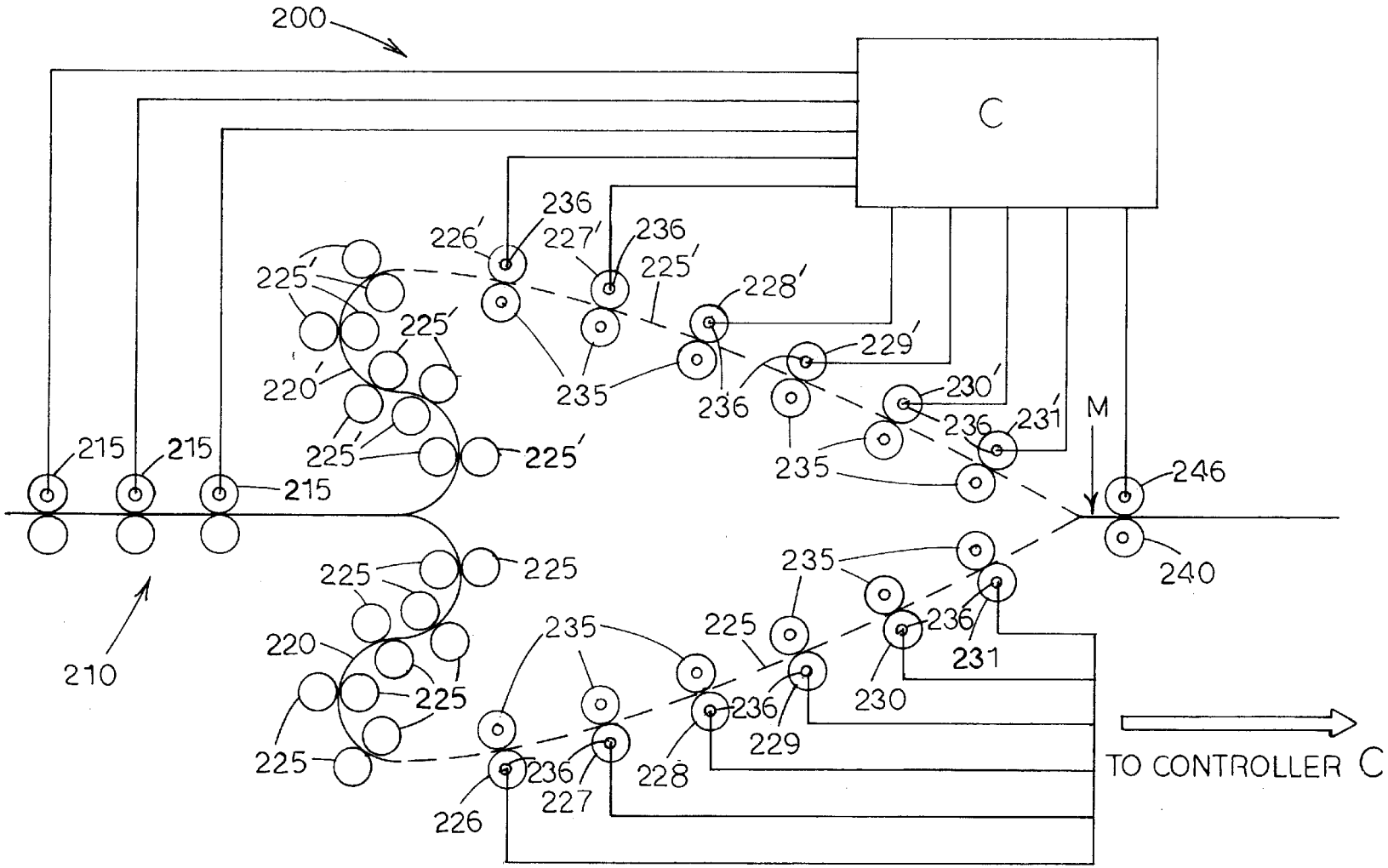
FIGS. 4A and 4B of the drawings are schematic plan and elevation views respectively of an apparatus for merging sheets according to this invention.
Figure 4B:
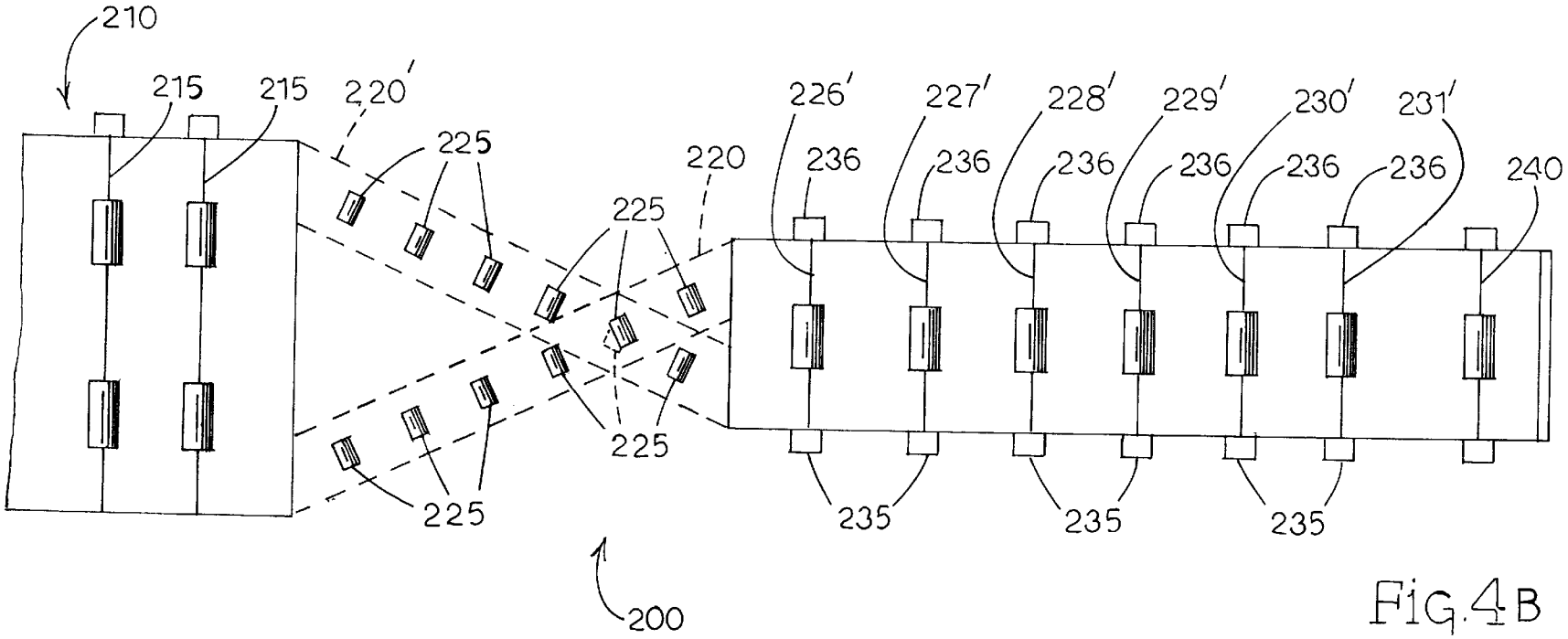

Having described the method behind the invention, an apparatus for carrying out that method will now be described with reference to FIGS. 4A and 4B.

After leaving the cutter/burster area, which is conventional technology, the side-by-side sheet streams are fed into merging apparatus generally designated as 200 via the infeed conveyor generally designated as 210. In some instances, the cutter/burster area can be considered part of infeed conveyor 210. Infeed conveyor 210 has a plurality of infeed drive roller pairs 215 driven by motors 216 electronically connected to controller C. Controller C is a conventional microprocessor-based device that can be used to control any and all functions of the merging apparatus 200.

As in the preferred embodiment it is preferred to take the sheet streams off the infeed plane to subject them to their different acceleration/speed profiles, conventional 45° turnover guides 220, 220' are used. Two sets of turnover guides are used, with one set taking a sheet stream upward and the other set taking a sheet stream downward. Though only shown schematically in FIGS. 4A and 4B, these turnover guides include driven roller couples 225 which are also electronically connected to controller C. In order not to clutter the figures of drawings, these conventional electronic connections are not shown. Furthermore, these roller couples are conventional and include a motor (not shown)-driven roller opposite an idler roller.

As the sheet streams come out of their respective turnover guides 220, 220', they are captured by first and second independent drives 225, 225'. In the preferred embodiment of the invention, where first and second independent drives are vertically spaced from each other, first and second independent drives 225, 225' comprise upper and lower independent drives 225, 225'. Each of these drives comprise a plurality of drive roller pairs 226, 226', 227, 227', 228, 228', 229,229', 230, 230', 231, 231'. While the exemplary embodiment described herein uses six (6) drive roller pairs per independent drive, any number is possible and the more used the better the sheet handling of merging apparatus 200. Each drive roller pair should be driven by its own motive force, e.g., motor 236. Each motor 236 will be connected to controller C. Controller C will control each drive roller pair so as to accelerate the sheets in that sheet stream faster than the drive roller pair before it. Thus, as an example, in a 6-drive roller pair as shown in FIGS. 4A and 4B, sheets will be accelerated from the infeed speed to the outfeed speed in six incremental steps.

To provide for good sheet control, typically, roller pairs will be separated by a distance less than the length of a sheet. Accordingly, at any one time, a sheet will be within the grip of two roller pairs. However, as described above, adjacent roller pairs will not be operating at the same speed. To prevent damage to the sheets when being acted upon by two different speed drive roller pairs, each drive roller pair contains a one-way clutch 235, typically in the form of a one-way slip clutch that allows the sheet to leave the previous roller pair when fully under the control of the next roller pair. The fact that the individual sheets of each sheet stream are under the constant positive control of at least one pair of drive rollers provides for superior paper control.

The upper and lower drive roller pairs increase to their outfeed speeds along different speed profiles. Typically, their profiles will be such that sheets are 180° out of phase when they reach outfeed drive rollers 240 at merge position M. By 180° out of phase, it is meant that individual sheets from the upper and lower drive roller pairs alternatingly reach outfeed roller 240. With such a speed profile between the upper and lower drive roller pairs, the increase in size gaps between the sheets of each stream will be filled with a sheet from the other stream. Thus, resulting will be a single stream of sheets with a small gap between its sheets. This single stream can easily be handled by typical downstream sheet handling equipment such as a collector or accumulator.

It should be noted that by use of the instant invention, the sheet gaps can be increased without having to stop the feeding of any sheets. This is superior because constant sheet and conveyor motion is always better than a start-stop sheet and conveyor motions. The stop-start motion is harder on mechanical components and slower than a continuous motion. Accordingly, while it is possible to create the gaps between the sheets and the out of phase arrangement using stop-start conveyors, it is not preferred.

As described above, each drive roller pair is preferably driven by its own motive source, such as its own servo motor 236. It is also possible that a single common motive force, e.g., motor and pulleys, can be used to drive the upper set of drive rollers and a single common motive force, e.g., motor and pulleys, can be used to drive the lower set of drive rollers. Through the use of differently sized gears or pulleys, the increasing speed profile can still be created so as to increase the sheet feeding speed and change the phase between streams.

The apparatus for merging sheets according to the invention can be implemented with any size sheets. By adjusting the controller C and the upper and lower speed profiles, any size sheet can be handled with the only limitation being that the sheet is not too wide to fit within upper and lower sheet paths 225, 225'.

The two-up stream of sheet material used with the instant invention can comprise either a roll of two-up material or a fan-folded web of two-up material. Additionally, it is possible for the two-up material to be fed directly from a printer to the apparatus for merging sheets.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. An apparatus for merging sheet streams conveyed in side-by-side streams in a conveying direction into a single stream, comprising:

(a) an infeed conveyor for conveying at least a first sheet stream and a second sheet stream side-by-side in a conveying direction; and (b) a merger for merging said side-by-side first and second sheet streams such that said first and second sheet streams are conveyed in a single stream, said merger comprising:

(i) means for separating said side-by-side first and second conveyed sheet streams; and (ii) means for separately conveying said first and second separated sheet streams to a merge location for merger of said first and second sheet streams into a single stream, wherein said first sheet stream includes a plurality of gaps defined between each adjacent sheet in said first sheet stream and said separately conveying means increases each gap in said first sheet stream, increases the speed of said sheets in said first sheet stream, and increases the speed of said sheets in said second sheet stream.

2. The apparatus of claim 1 wherein said means for separately conveying said separated sheet streams to a merge location comprises at least first and second sheet driving means, said first sheet driving means producing a first acceleration/speed profile for said first sheet stream and said second driving means producing a second acceleration/speed profile for said second sheet stream, said first acceleration/speed profile being different from said second acceleration/speed profile, and wherein said first and second sheet driving means convey said first and second separated sheet streams according to said different first and second acceleration/speed profiles to accelerate said first and second sheet streams.

3. The apparatus of claim 2 wherein said first and second sheet driving means produce said first and second acceleration/speed profiles to increase the speed of sheets in each sheet stream from an infeed speed to an outfeed speed and cause said first and second sheet streams to be conveyed to said merge location 180° out of phase from each other.

4. The apparatus of claim 2 wherein said means for separating said side-by-side first and second conveyed sheet streams comprises first and second stationary curved guide members for directing said first and second sheet streams to said first and second sheet driving means, respectively.

5. The apparatus of claim 1 wherein said first and second sheet driving means converge at one end thereof.

6. The apparatus of claim 1 wherein said first and second sheet driving means are vertically spaced.

7. The apparatus of claim 2 wherein said first and second sheet driving means each comprise a plurality of independently controlled conveyors.

8. The apparatus of claim 7 wherein each independently controlled conveyor further comprises a one-way clutch.

9. The apparatus according to claim 1, wherein said infeed conveyor includes a means for changing a single two-up web into said side-by-side first and second sheet streams.

10. The apparatus according to claim 1 wherein said separately conveying means increases each gap in said first sheet stream to a distance greater than a length of each sheet in said first and second sheet streams.

11. The apparatus according to claim 1 wherein said second sheet stream includes a plurality of gaps defined between each adjacent sheet in said second sheet stream and said separately conveying means increases each gap in said second sheet stream to a distance greater than a length of each sheet in said first and second sheet streams.

12. The apparatus according to claim 1 wherein said separately conveying means includes a first conveyor means for subjecting said first sheet stream to a first sequence of acceleration rates and a second conveyor means for subjecting said second sheet stream to a second sequence of acceleration rates, the first sequence being different from the second sequence.

13. An apparatus for merging sheet streams conveyed side-by-side in a conveying direction such that said sheet streams are merged into a single stream, comprising:

(a) conveying means for conveying said side-by-side sheet streams in a conveying direction; and (b) means for merging said side-by-side conveyed sheet streams such that said sheet streams are conveyed in a single stream in said conveying direction and not inverted, said means for merging comprising:

(i) curved guide members for separating said side-by-side sheet streams; and (ii) at least first and second conveyors for separately conveying said separated sheet streams to a merge location for merger of said sheet articles whereby each of said sheet articles is conveyed to said merge location into a seriatim manner.

14. The apparatus of claim 13 wherein said first and second conveyor means are adapted for conveying said separately conveyed sheet streams at different acceleration profiles and at different speeds to said merge location.

15. A method of merging sheets conveyed in two side-by-side streams into a single stream of sheets, comprising the steps of:

(a) conveying at least first and second streams of sheets in a side-by-side relationship in a conveying direction, said first stream of sheets including a plurality of gaps defined between each adjacent sheet in said first sheet stream;

(b) merging said side-by-side first and second streams of sheets such that said first and second streams of sheets are conveyed in a single stream, whereby merging said first and second sheet streams is accomplished by:

(i) separating said side-by-side first and second sheet streams; and (ii) separately conveying said separated first and second sheet streams to a merge location where said first and second sheet streams are merged into a single stream by directing said first sheet stream to a first sheet conveying means and directing said second sheet stream to a second sheet conveying means, wherein said first sheet conveying means increases each gap in said first sheet stream and increases the speed of sheets in said first sheet stream, and said second conveying means increases the speed of sheets in said second sheet stream.

16. The method of claim 15 wherein said step of separately conveying further comprises providing said first and second sheet conveying means with first and second independently controlled sheet driving means, respectively, wherein said first sheet driving means conveys said first sheet stream according to a first acceleration/speed profile defined at least in part by a first plurality of acceleration rates and said second sheet driving means conveys said second sheet stream according to a second acceleration/speed profile defined at least in part by a second plurality of acceleration rates, said second acceleration/speed profile being different from said first acceleration/speed profile.

17. The method of claim 16 wherein said step of separately conveying said first and second sheet streams according to different first and second acceleration/speed profiles to a merge location further comprises increasing the speed of the sheets in each sheet stream and causing said first and second sheet streams to be 180° out of phase.

18. The method of claim 17 wherein said step of merging further comprises alternatingly feeding a sheet from one of said first and second streams into a gap in the other stream.

19. The method of claim 18, wherein said merging is conducted without stopping conveyance of either of said first and second sheet streams.

20. The method according to claim 15 wherein said first sheet conveying means increases each gap in said first sheet stream to a distance greater than a length of each sheet in said first and second sheet streams.

21. The method according to claim 15 wherein said second stream of sheets includes a plurality of gaps defined between each adjacent sheet in said second sheet stream and said second sheet conveying means increases each gap in said second sheet stream to a distance greater than a length of each sheet in said first and second sheet streams.

22. The method according to claim 15 wherein said first sheet conveying means causes said first sheet stream to accelerate at a first plurality of acceleration rates and said second sheet conveying means causes said second sheet stream to accelerate at a second plurality of acceleration rates, and said first plurality of acceleration rates is different from said second plurality of acceleration rates.

23. An apparatus for merging sheet streams comprising:

(a) a microprocessor-based control device;

(b) means for feeding sheets along an infeed path including infeed driving means electronically communicating with the control device;

(c) a first guide means for receiving a first stream of sheets from the sheet feeding means and transporting the first stream of sheets along a first sheet stream path;

(d) a second guide means for receiving a second stream of sheets from the sheet feeding means and transporting the second stream of sheets along a second sheet stream path;

(e) a plurality of successive first driving means for transporting the first stream of sheets along the first sheet stream path to a merge location, wherein each of the first driving means accelerates the first stream of sheets at a rate different from adjacent first driving means, the plurality of first driving means collectively define a first acceleration profile, and each of the first driving means electronically communicates with the control device; and (f) a plurality of successive second driving means for transporting the second stream of sheets along the second sheet stream path to the merge location, each of the second driving means electronically communicating with the control device.

24. The apparatus according to claim 23 wherein each of the second driving means accelerates the second stream of sheets at a rate different from adjacent second driving means and the plurality of second driving means collectively define a second acceleration profile different from the first acceleration profile.

25. The apparatus according to claim 23 wherein the first sheet stream path deviates upwardly from a terminus of the infeed path.

26. The apparatus according to claim 25 wherein the second sheet stream path deviates downwardly from the terminus of the infeed path.

27. The apparatus according to claim 23 wherein the first and second sheet stream paths are horizontally spaced from each other.

28. The apparatus according to claim 23 wherein the control device is adapted to cause the plurality of first driving means to increase a gap between adjacent sheets in the first stream of sheets to a distance greater than a length of each sheet in the first stream of sheets.

29. The apparatus according to claim 28 wherein the control device is adapted to cause the plurality of second driving means to increase a gap between adjacent sheet in the second stream of sheets to a distance greater than a length of each sheet in the second stream of sheets.

30. The apparatus according to claim 23 wherein the control device is adapted tc adjust the first and second acceleration profiles to permit each sheet in the second stream of sheets to enter the merge location between each adjacent pair of sheets in the first stream of sheets.

31. The apparatus according to claim 23 wherein each of the first driving means is spaced from adjacent first driving means at a distance less than a length of each sheet in the first stream of sheets, and each of the second driving means is spaced from adjacent second driving means at a distance less than a length of each sheet in the second stream of sheets.

32. The apparatus according to claim 23 wherein each of the first driving means and each of the second driving means includes a one-way clutch.

33. The apparatus according to claim 23 wherein each of the first driving means and each of the second driving means includes a motor in electronic communication with the control device.

34. An apparatus for merging sheet streams conveyed in side-by-side streams in a conveying direction into a single stream, comprising:

(a) an infeed conveyor for conveying at least a first sheet stream and a second sheet stream side-by-side in a conveying direction; and (b) a merger for merging said side-by-side first and second sheet streams such that said first and second sheet streams are conveyed in a single stream, said merger comprising:

(i) means for separating said side-by-side first and second conveyed sheet streams;

(ii) means for separately conveying said first and second separated sheet streams to a merge location for merger of said first and second sheet streams into a single stream, said separately conveying means including first and second independently controlled sheet driving means, said first sheet driving means producing a first acceleration/speed profile for said first sheet stream and said second driving means producing a second acceleration/speed profile for said second sheet stream, said first acceleration/speed profile being different from said second acceleration/speed profile, and wherein said first and second sheet driving means convey said first and second separated sheet streams according to said different first and second acceleration/speed profiles to accelerate said first and second sheet streams to an outfeed speed and convey said first and second sheet streams to said merge location and merge said first and second sheet streams into a single stream; and (iii) first and second stationary curved guide members for directing said first and second sheet streams to said first and second sheet driving means, respectively.

35. An apparatus for merging sheet streams conveyed in side-by-side streams in a conveying direction into a single stream, comprising:

(a) an infeed conveyor for conveying at least a first sheet stream and a second sheet stream side-by-side in a conveying direction; and (b) a merger for merging said side-by-side first and second sheet streams such that said first and second sheet streams are conveyed in a single stream, said merger comprising:

(i) means for separating said side-by-side first and second conveyed sheet streams;

(ii) means for separately conveying said first and second separated sheet streams to a merge location for merger of said first and second sheet streams into a single stream, said separately conveying means including first and second independently controlled sheet driving means, said first sheet driving means including a plurality of first independently driven conveyors and producing a first acceleration/speed profile for said first sheet stream, and said second driving means including a plurality of second independently driven conveyors and producing a second acceleration/speed profile for said second sheet stream, said first acceleration/speed profile being different from said second acceleration/speed profile, and wherein said first and second sheet driving means convey said first and second separated sheet streams according to said different first and second acceleration/speed profiles to accelerate said first and second sheet streams to an outfeed speed and convey said first and second sheet streams to said merge location and merge said first and second sheet streams into a single stream; and (iii) first and second stationary curved guide members for directing said first and second sheet streams to said first and second sheet driving means, respectively.

36. An apparatus for merging sheet streams conveyed in side-by-side streams in a conveying direction into a single stream, comprising:

(a) an infeed conveyor for conveying at least a first sheet stream and a second sheet stream side-by-side in a conveying direction; and (b) a merger for merging said side-by-side first and second sheet streams such that said first and second sheet streams are conveyed in a single stream, said merger comprising:

(i) means for separating said side-by-side first and second conveyed sheet streams;

(ii) means for separately conveying said first and second separated sheet streams to a merge location for merger of said first and second sheet streams into a single stream, said separately conveying means including first and second independently controlled sheet driving means, said first sheet driving means including a plurality of first independently driven conveyors, each of the first independently driven conveyors including a one-way clutch, and said first sheet driving means producing a first acceleration/speed profile for said first sheet stream, and said second driving means including a plurality of second independently driven conveyors, each of the second independently driven conveyors including a one-way clutch, and said second driving means producing a second acceleration/speed profile for said second sheet stream, said first acceleration/speed profile being different from said second acceleration/speed profile, and wherein said first and second sheet driving means convey said first and second separated sheet streams according to said different first and second acceleration/speed profiles to accelerate said first and second sheet streams to an outfeed speed and convey said first and second sheet streams to said merge location and merge said first and second sheet streams into a single stream; and (iii) first and second stationary curved guide members for directing said first and second sheet streams to said first and second sheet driving means, respectively.

* * * * *